US011873649B2

(12) United States Patent
Buzon

(10) Patent No.: US 11,873,649 B2
(45) Date of Patent: Jan. 16, 2024

(54) SET COMPRISING A CONNECTION FOOT AND A SOIL COVERING ELEMENT SUPPORT ELEMENT

(71) Applicant: Buzon Pedestal International S.A., Herstal (BE)

(72) Inventor: Laurent Buzon, Herstal (BE)

(73) Assignee: BUZON PEDESTAL INTERNATIONAL S.A., Herstal (BE)

( * ) Notice: Subject to any disclaimer, the term of this patent is extended or adjusted under 35 U.S.C. 154(b) by 228 days.

(21) Appl. No.: 17/414,012

(22) PCT Filed: Dec. 17, 2019

(86) PCT No.: PCT/EP2019/085816
§ 371 (c)(1),
(2) Date: Jun. 15, 2021

(87) PCT Pub. No.: WO2020/127397
PCT Pub. Date: Jun. 25, 2020

(65) Prior Publication Data

US 2022/0056707 A1 Feb. 24, 2022

(30) Foreign Application Priority Data

Dec. 20, 2018 (BE) ..... 2018/0157

(51) Int. Cl.
*E04F 15/02* (2006.01)
*E04F 15/024* (2006.01)

(52) U.S. Cl.
CPC .. *E04F 15/02464* (2013.01); *E04F 15/02022* (2013.01); *E04F 15/02452* (2013.01)

(58) Field of Classification Search
CPC ..... E04F 15/02464; E04F 15/02022; E04F 15/02452; E04F 15/02044; E04F 15/0247; E04F 15/02458; E04F 15/02494
(Continued)

(56) References Cited

U.S. PATENT DOCUMENTS 7,918,059 B2 * 4/2011 Repasky ..... E04F 15/02183 52/126.6
8,438,805 B2 * 5/2013 Repasky ..... E04F 15/02183 52/263

(Continued)

FOREIGN PATENT DOCUMENTS

DE 2020130103515 1/2014
DE 102013113267 6/2015

(Continued)

*Primary Examiner* — Brian E Glessner
*Assistant Examiner* — Adam G Barlow
(74) *Attorney, Agent, or Firm* — Jacobson Holman PLLC

(57) ABSTRACT

A set comprising a connection foot and a soil covering element support element, which support element comprises a basis provided for being applied on a surface raising pedestal, which basis comprises a stop member, which connection foot is provided for connecting the support element to the pedestal, which basis of the support element comprises a set of attachment slats, which connection foot comprises a set of first attachment members, the first attachment members being applied in such a manner as to be able to engage between the attachment slats and enter into contact with them so as to enable a translatory movement between the support element and the connection foot, which connection foot comprises a second set of attachment members provided for gripping with the pedestal and enabling a rotation of the connection foot with respect to the pedestal.

21 Claims, 10 Drawing Sheets

(58) Field of Classification Search
USPC ... 52/126.1, 126.4, 126.5, 126.6, 126.7, 263
See application file for complete search history.

(56) References Cited

U.S. PATENT DOCUMENTS

| | | | | |
|---|---|---|---|---|
| D685,745 | S | 7/2013 | Lee et al. | |
| 8,733,031 | B2 * | 5/2014 | Knight, III | E04F 15/04 52/126.5 |
| 10,113,320 | B1 * | 10/2018 | Cataldi | E04F 15/02452 |
| 10,865,938 | B2 * | 12/2020 | Buzon | F16M 11/24 |
| 2008/0222973 | A1 * | 9/2008 | Lee | E04F 15/02488 52/126.6 |
| 2013/0219809 | A1 * | 8/2013 | Tabibnia | E04D 11/007 52/126.6 |
| 2021/0388596 | A1 * | 12/2021 | Lee | E01C 5/001 |
| 2022/0282493 | A1 * | 9/2022 | Buzon | E04F 15/02044 |
| 2022/0282495 | A1 * | 9/2022 | Tabibnia | E04F 15/0247 |
| 2022/0333367 | A1 * | 10/2022 | Ghiringhelli | E04F 15/02464 |

FOREIGN PATENT DOCUMENTS

| | | | | |
|---|---|---|---|---|
| DE | 102014115272 | | 4/2016 | |
| DE | 102014115272 | A1 * | 4/2016 | E04F 15/02044 |
| DE | 202016001842 | | 4/2016 | |
| EP | 1566503 | | 8/2005 | |
| EP | 3181779 | | 6/2017 | |
| EP | 3279405 | | 2/2018 | |

* cited by examiner

SET COMPRISING A CONNECTION FOOT AND A SOIL COVERING ELEMENT SUPPORT ELEMENT

The present invention relates to a set comprising a connection foot and a soil covering element support element, which support element comprises a basis provided for being applied on a surface raising pedestal, which basis comprises at a first longitudinal end a stop member which extends substantially perpendicular with respect to the basis, which connection foot is provided for connecting the support element to the pedestal.

Such a support element is known from US D 685 745. The known support element comprises a stop member having an ellipse shaped stop member, which is applied at a first longitudinal end of the basis. The support element serves to be applied on a surface raising pedestal and to support a soil covering element which is applied on the pedestal and which is situated at the height of a border of a wall. It is well known in surface elevation techniques or in compensation of surface inclination techniques to make use of pedestals. Those pedestals are applied on a soil, which is either flat or inclined. When the soil is flat the pedestals serve to raise the soil surface for creating a space which can be used for housing therein among others electric cables. When the soil is inclined, the pedestal not only serves to raise the surface, but also for compensating the slope. The soil covering, for example formed by pavers or a floor made of natural or synthetic wood, is than placed on the pedestal. For filling up the space between a partition or a wall and the first row of pedestals, use is made of support elements which are applied on the head of the pedestal and of which the stop member is placed against the wall or the partition.

A drawback of the known support element is that its use is limited to rectilinear wall or partitions. The modern architecture and the techniques and construction materials enable today the use of other geometrical shapes than the straight lines. There is thus a need to have raised surfaces which can be combined with non-rectilinear walls or partitions, or which are forming corners.

The object of the invention is to realize a support element which can be used with walls and partitions of different geometries and which offers a large flexibility for adjusting the position of the support element with respect to the wall or partition.

To this purpose a support element according to the invention is characterized in that the basis of the support element comprises a set of attachment slats which extend over at least 70% of the length of the basis, which connection foot comprises a set of first attachment members, the first attachment members being dimensioned and applied in such a manner as to be able to engage between the attachment slats of the set of attachment slats and enter into contact with them so as to enable a translatory movement between the support element and the connection foot, which connection foot comprises a second set of attachment members provided for gripping with the pedestal and enabling a rotation of the connection foot with respect to the pedestal. As the first attachment members can be engaged between the attachment slats this cooperation between the first attachment members and the slats will enable the support element to perform a translatory movement with respect to the pedestal. As moreover the second attachment members enable a rotation of the connection foot with respect to the pedestal, and as the support element is connected with the connection foot, the rotation of the connection foot will also enable the rotation of the support element with respect to the pedestal. This thus offers a large flexibility in adjusting the support element with respect to the wall or the partition.

A first preferred embodiment of a support element according to the invention is characterized in that the basis is provided with at least a first window which extends in a longitudinal way in the basis. These first windows serve for introducing therein insert parts which will than extend between soil covering elements for maintaining a distance between them.

A second preferred embodiment of a support element according to the invention is characterized in that the set of first attachment members comprises two pairs of first attachment members, the first attachment members being applied in such a manner that they each time form an angle of substantially 90° among them, one of the pairs being housed between the attachment slats and the other pair penetrates in the first window situated between the attachment slats of the first set when the connection foot is connected to the support element. This contributes to correctly guide the support element during its translatory movement with respect to the pedestal.

Preferably the basis also comprises a second window having a curved geometry, which second window extends at the height of a second longitudinal end of the basis, which second end is situated at the opposite side of the one of the first longitudinal end. This enables to apply even more insert parts and thus to make use of different geometries in the choice of the soil covering elements.

A third preferred embodiment of a support element according to the invention is characterized in that the or the window(s) is or are applied in a hollowing out foreseen in the basis. This contributes to facilitate the movement of the insert parts in the windows.

A fourth preferred embodiment of a support element according to the invention is characterized in that each insert part is provided for being applied in the window in such a manner that it can also perform a translatory movement within the window. This offers a large flexibility for applying the insert part.

Preferably the basis comprises a series of perforations crossing the basis. This enables to fix the support element on the pedestal by using the perforations for introducing screws therein serving for fixing the support element to the pedestal.

A fifth preferred embodiment of a support element according to the invention is characterized in that the set of first attachment members is applied on a first side of a disc around a center of that disc. The latter contributes to facilitate the translatory movement of the support element.

Preferably each first attachment member comprises a first segment which extends in a direction substantially perpendicular with respect to the first side of the disc and a second segment substantially perpendicular to the first segment and in a direction which extends so as to move away from the center of the disc, a third segment of the first attachment member being connected to the second segment and forms an angle situated between 15° and 35° with the first segment. This facilitates the connection foot engagement in the attachment slats.

A sixth preferred embodiment of a support element according to the invention is characterized in that the stop member is formed by at least one flap provided with a notch which extends over the height of the flap, the notch having a depth such as to enable a bending and/or a removal of a section of the flap situated between the notch and a distal end of the flap. The presence of a notch enables thus either to have said flap section bend, or to remove it, in order to thus adapt the support element to the geometry of the wall or the partition in face of which it will be placed. Because the support element can thus adapt to the geometry of the wall or partition, it becomes possible to foresee a support element for the soil covering up to the wall or partition, even if the latter is not rectilinear or forms a corner.

Preferably the notch is situated in a part of the flap situated between ⅓ and ⅔, in particular between 4/9 and 5/9, of the length of the flap. This enables on the one hand to keep always a section of the flap which will be in contact with the wall or partition, and on the other hand to enable sufficient flexibility of the flap or to remove a section thereof, and to adapt the support element to a large variety of wall or partition geometry.

Preferably the or the flap(s) is or are placed on a third foot and offset with respect to the basis. This enables to break a part of the flap without however altering the basis of the support element.

Preferably each insert part is provided for being applied in the window in such a manner as to be rotated in the window. This contributes to facilitating the orientation of the insert pieces between the covering elements.

Preferably the support element is provided with a hole applied at the height of the first longitudinal end, which hole is dimensioned for fixing therein the insert part. This increases the possibilities for applying insert parts.

The invention will now be described with reference to the drawings which illustrates embodiments of the support element and the set according to the invention:

FIG. 1 shows a support element according to the invention and which is applied on a pedestal;

FIGS. 2*a, b* and *c* show an embodiment of a support element according to the invention;

Figure 10A:
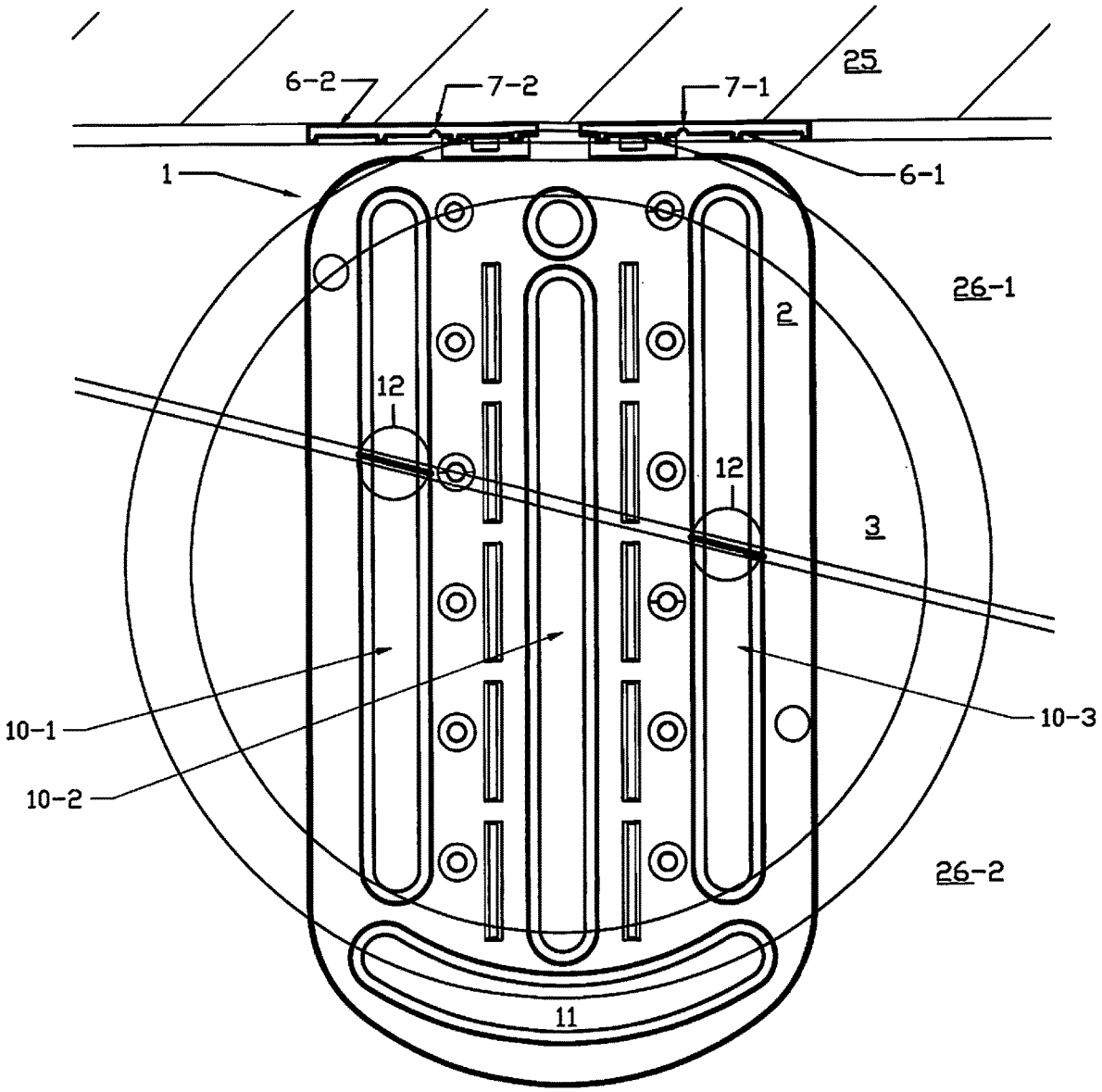

FIGS. 10*a, b* and *c* illustrate the use of the support element according to the invention.

In the drawings a same reference sign has been allotted to a same or analogous element.

Figure 1:
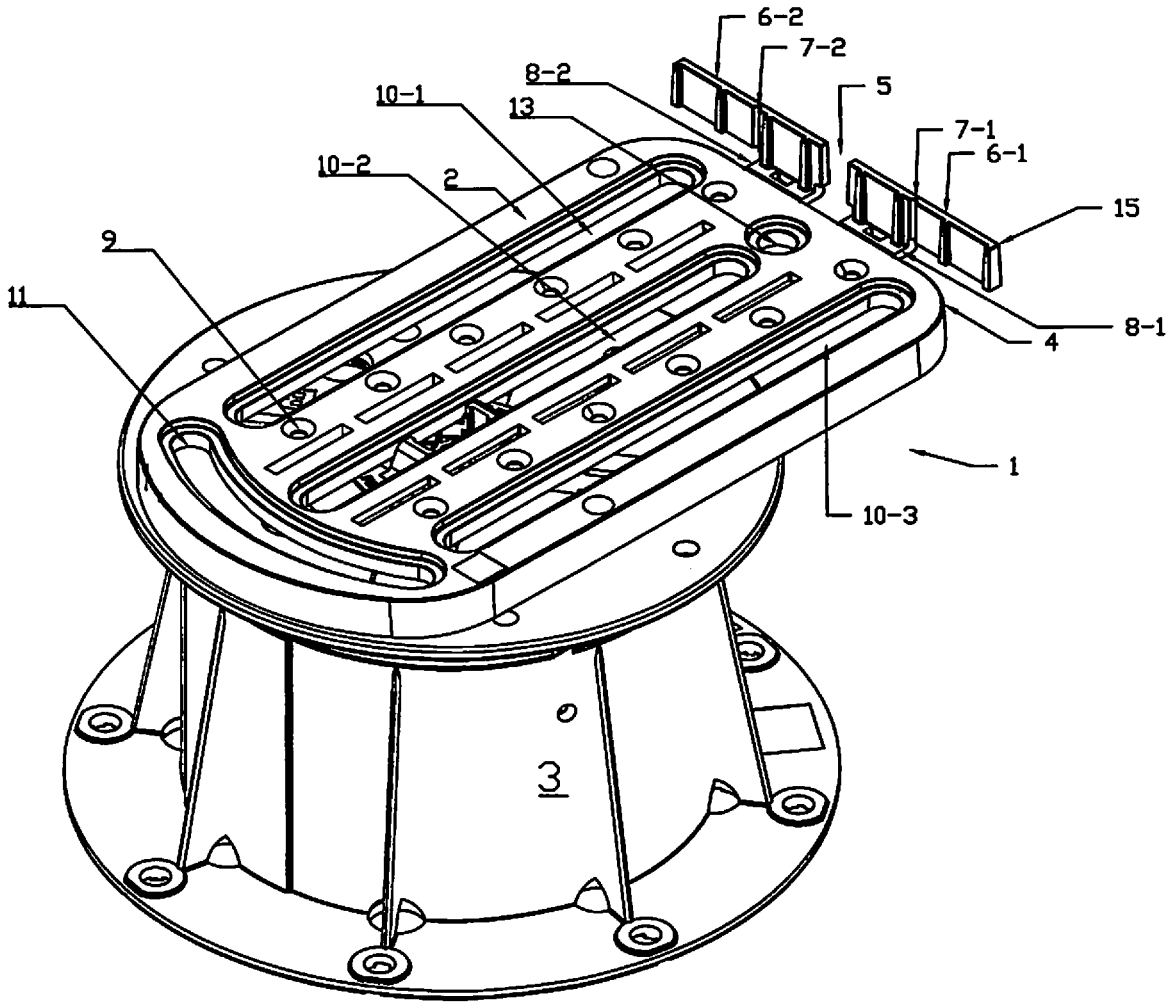

FIG. 1 shows a support element 1 according to the invention and applied on a pedestal 3. The pedestal and its use are generally known and are for example described in the patents EP 1 027 511 and EP 3 181 779 which belong to the present applicant. Those pedestals serve either to compensate a soil inclination, or to raise the floor, for example for building a terrasse or for creating a space for cables or conducts underneath a raised floor. The support element is provided for being mounted on the head of the pedestal. After having been placed on the head of the pedestal it is moved with respect to the head of the pedestal for adjusting its position with respect to a wall or a partition. If necessary, it will then be fixed on the head of the pedestal. The soil covering (not shown in this FIG. 1) is then applied by placing at least a fraction, for example a corner or a segment, of this soil covering on the support element 1.

Figure 2A:
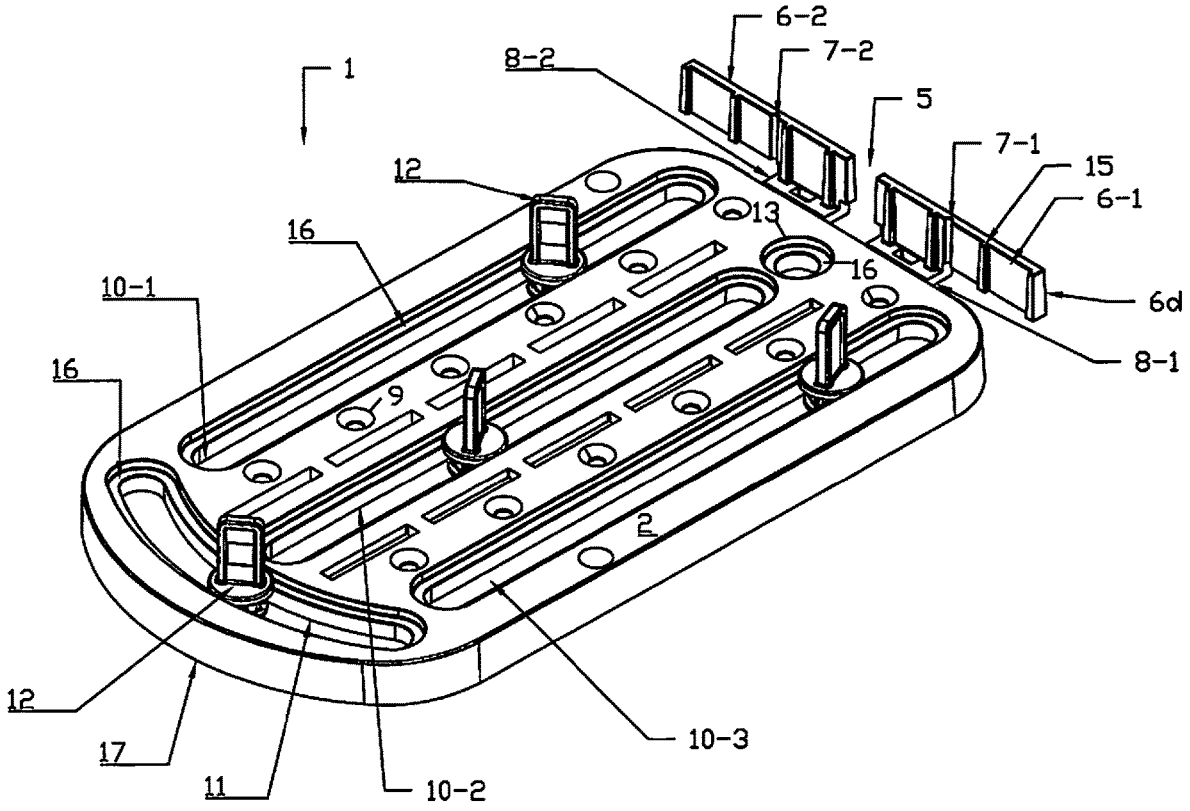

The FIGS. 2*a, b* and *c*, as well as FIG. 1, show an embodiment of a support element according to the invention. The support element 1 is preferably manufactured in a plastic material, such as polypropylene, but it will be clear that other materials, such as epoxy reinforced with glass fibers, or even natural materials, such as wood, could be used.

The support element 1 comprises a basis 2 provided for being mounted on a surface raising pedestal 3. The basis comprises an upper face, visible in the FIGS. 1 and 2*a* and *b* and an under face, visible in FIG. 3. This basis comprises at a first longitudinal end 4 a stop member 5 which extends substantially perpendicular with respect to the basis. The stop member is formed by at least one flap 6-1 provided with a notch 7-1, which extends over the height of the flap. In the embodiment shown in the FIGS. 1 to 3, the stop member comprises two flaps 6-1 and 6-2, each provided with a notch 7-1, 7-2. The two flaps are separated by a distance between them, the one flap being situated at the right and the other at the left with respect to a central line of the support element. The notch has a depth such as to enable a bending and/or a removal by breaking of a first section of the flap situated between the notch and a distal end 6*d* of the flap. This notch is for example realized by leaving a cut-out in the flap upon manufacturing, for example by casting. Preferably the notch extends over the whole height of the flap. Preferably the notch 7-1, 7-2 is situated in the part of the flap situated between one third (⅓) and two third (⅔), in particular between 4/9 and 5/9, of the length of the flap. This enables on the one hand to always keep a second section of the flap which will be in contact with the wall or partition, as will be described hereunder, and on the other hand to enable sufficient bending of the first section of the flap or to remove that first section, and to enable to adapt the support element to a large geometry variety of the wall or partition. Preferably, the flap also comprises reinforcing ribs 15 of which one is placed at the distal end 6*d* of the flap and at least another one in each section of the flap. As their names indicates, they serve to rigidify the flap. The reinforcing ribs are placed on the side of the flap oriented towards the basis, while the front side of the flap is preferably smooth for facilitating the application against the wall or the partition. Preferably the flap has a thickness of 3 mm and the reinforcing rib a thickness of 2 mm, which makes a total thickness of 5 mm at the height of the reinforcing rib. This thickness of 2 mm enables to create a distance between the flap and the soil covering which will be applied against the flap and the reinforcing ribs, leaving a 2 mm space with serve for drainage purpose, for example of rainwater.

Preferably the or the flap(s) is or are applied on a third foot 8-1,8-2, which is offset with respect to the basis 2. This enables to break off a part of the flap, or to remove one of the flaps, without altering the basis of the support element. The flap is connected to the third foot at the height of its second section, in order not to disturb the bending or removal of the first section.

Preferably the basis comprises a series of perforations 9 crossing that basis. Those perforations are aligned according to at least one row and applied at equidistance of each other. This enables to fix the support element, for example by means of a screw, on the pedestal by using the perforations for introducing therein the screws and thus fix the support element on the pedestal after it has been correctly positioned. The presence of a series of perforations enable to choose one or more fixing points in function of the orientation of the support element with respect to the head of the pedestal 3. Preferably each perforation comprises at the level of the upper side of the basis a conical notch out enabling to house the head of the screw which fixes the support element to the pedestal.

Figure 2B:
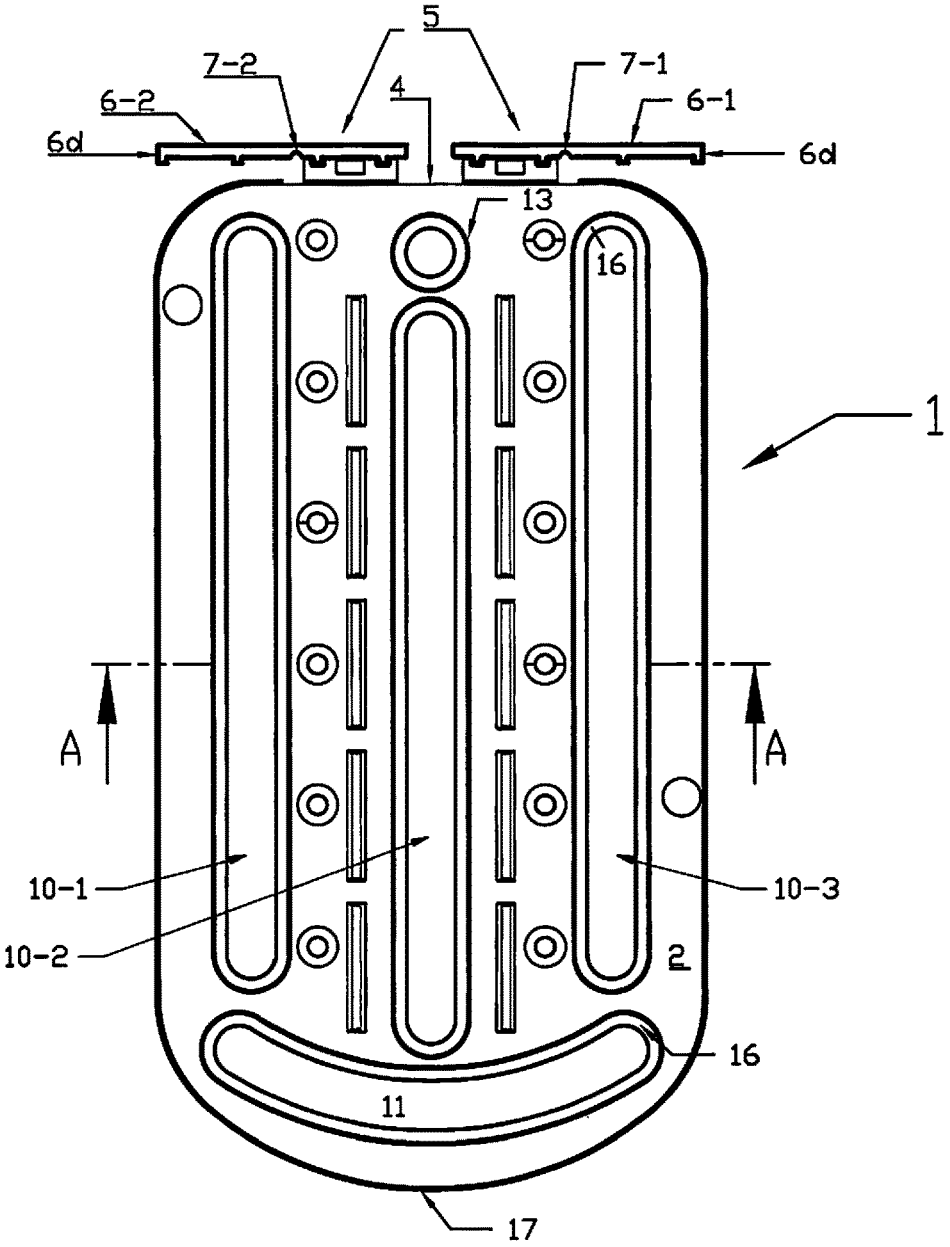
Figure 2C:
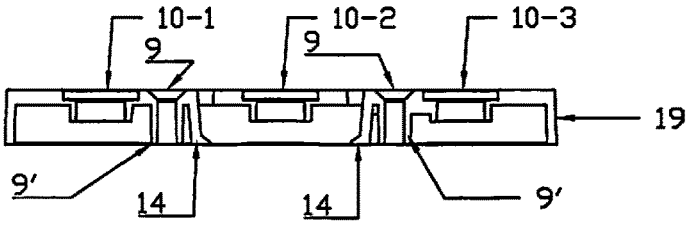

According to a preferred embodiment each perforation is extended by a tube 9', as illustrated in FIG. 2*c*, which shows a cross section view along the line A-A' of FIG. 2*b*. This tube extends as from the under side of the basis. This basis is preferably provided with a skirt 19 which extends over the whole circumference of the basis and surrounds the under side of the basis. The tubes have the same height as the skirt in order to remain within the periphery delimited by that skirt.

The support element 1 according to the invention comprises at least one window. The embodiment of the support element 1 illustrated in the FIGS. 1 to 3 comprises three first windows 10-1, 10-2 and 10-3, which extends over at least 70% of the length of the basis and lengthwise in the basis 2. These first windows extend in parallel among them and cross the basis. One of the first windows 10-2 extends between two rows of perforations 9. These first windows serve for introducing therein the insert parts 12 which will than extend between the soil covering elements, as will be described hereinafter in more details, for maintaining a distance among them. Preferably the or the window(s) is or are applied in a cut-out 16 applied in the upper side of the basis. This cut-out extends each time over the whole circumference of the first window and forms a platform which serves for guiding and support of the insert part 12 which will be housed in the first window.

In addition to the first windows, the support element comprises preferably also a second window 11, which has a curved geometry, which second window extends at the height of a second longitudinal end 17 of the basis, which second end is opposite to the first end. That second end has preferably also a curved geometry, which matches the one of the second window. That second window also serves for introducing therein insert parts 12 and thus make use of different geometries in the choice of soil covering elements. The second window also comprises a cut-out 16. The support element is also provided with a hole 13 which extends as from the upper side of the basis and crosses this basis. This hole is situated at the height of the first longitudinal end 4. The hole is dimensioned for fixing an insert part 12 and comprises preferably a cut-out similar to the one applied for the windows.

Figure 3:
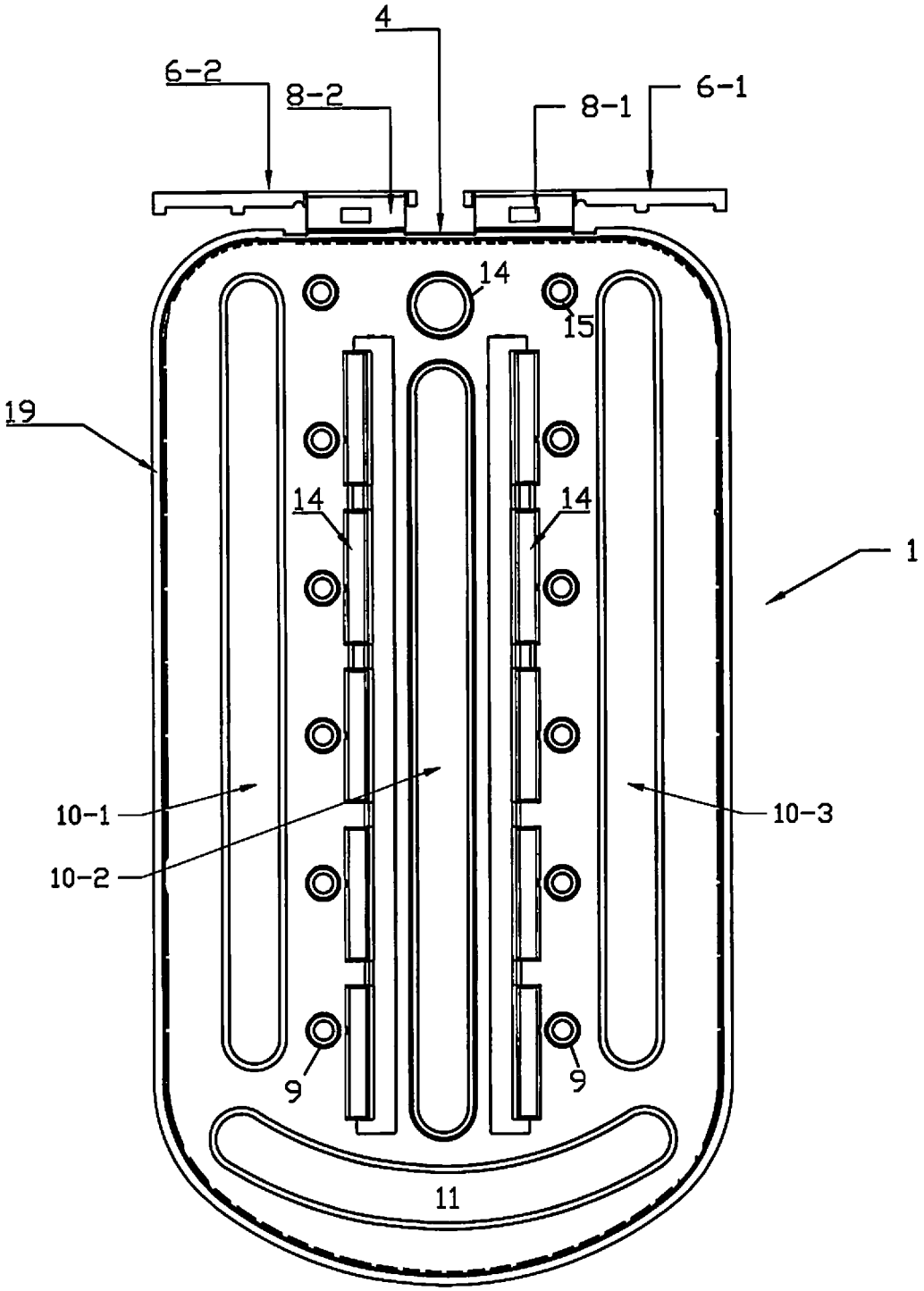
FIG. 3 shows a view from the bottom of an embodiment of a support element according to the invention.

FIG. 3 shows a front view of the underside of the embodiment of a support element according to the invention. This underside is provided with a set of attachment slats 14 which extend over at least 70% of the length of the basis. The latter serve for applying for example a connection foot, which itself will be fixed on the head of the pedestal, as will be described hereunder. The attachment slats preferably comprise an L shaped geometry which extend as from the underside. Of course, other geometries such as J or V shaped could also be considered. The attachment slats are preferably applied in a discontinuous manner for facilitating the de-casting during the manufacturing of the support element and keeping the rigidity of the support element. Preferably, as illustrated in the FIGS. 2*c* and 3, the attachment slats extend in parallel on both sides of the first window 10-2. They are situated between the first window 10-2 and the series of perforations 9. Preferably the attachment slats are aligned along two rows and applied in each row in an equidistant manner among them. The slats of two rows are applied face to face. Thus, the attachment slats will as if to say form a sliding rail which will help the guidance of the support element during its movement with respect to the connection foot and the pedestal head. By this combination of the connection foot the attachment slats it is possible to impose a translatory movement to the support element so that it can be moved over the pedestal head.

Figure 4:
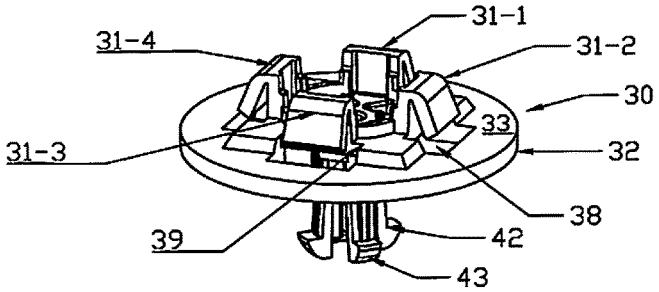
FIG. 4 shows an embodiment of a connection foot serving for connecting the support element to the pedestal.

The connection between the pedestal head and the embodiment of the support element according to the invention will be realized by using the connection foot 30, of which an embodiment is illustrated in FIG. 4. The connection foot is preferably manufactured in the same material as the one of which the support element is manufactured. This connection foot 30 comprises a set of first attachment members having at least a pair of first attachment members 31. Preferably the set of first attachment members comprises four attachment members 31-1 to 31-4. The first attachment members being applied in such a manner that each time two first attachment members being applied opposite to each other. Thus, in the example illustrated in FIG. 4 the first attachment members are applied in such a manner that they form each time an angle of substantially 90° among them. One of the pairs being housed between the attachment slats and the other one penetrates into the first window situated between the attachment slats of the first set when the connection foot is connected to the support element. The first attachment members being applied and dimensioned in such a manner as to be able to house between the attachment slats 14 of the first set and be in contact with them when the connection foot is connected to the support element. When the set of first attachment members comprises four attachment members two of them, which are opposite to each other, are in contact with the slats and the two others penetrate in the first window 10-1.

Figure 5:
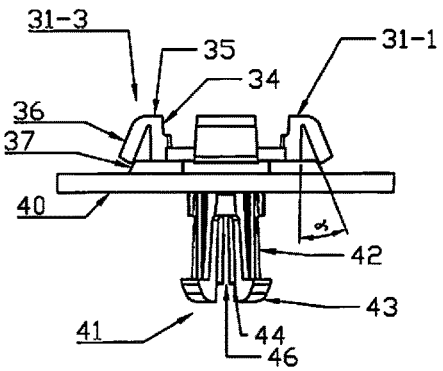
FIG. 5 shows a cross-section view through the connection foot.
Figure 6:
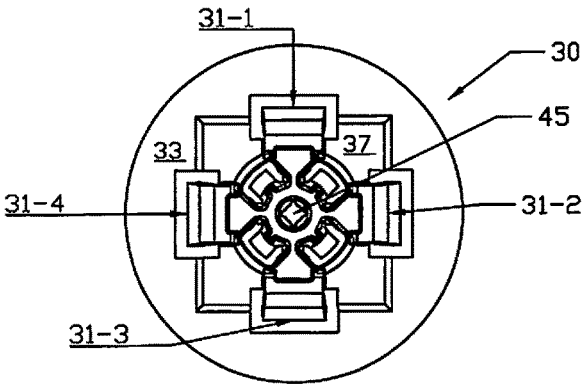
FIG. 6 shows a view from above of the connection foot.

Preferably the first set of attachment members is applied on a first side 33 of a disc 32 around the center of the disc, which is part of the connection foot. The four first attachment members 31-1 to 31-4 are applied in such a manner as to leave around the center of the disc enough space for introducing a third attachment member 22 which is part of an insert part 12, as will be described hereunder. The use of the disc will facilitate the rotation of the connection foot when it is applied on the head of the pedestal. Each first attachment member comprises a first segment 34, as illustrated in FIG. 5, which extend in a direction substantially perpendicular with respect to the first side 33 of the disc. Each first attachment member also comprises a second segment 35 which extend substantially perpendicular to the first segment 34 and in a direction which extend so as to move away from the center of the disc. A third segment 36 of the first attachment member being connected to the second segment 35 and forms an angle $\alpha$ situated between 15° and 35° with the first segment 34. The fact that the first and third segment form an angle among them and that they are connected among them by the second segment, will give to this first attachment member a certain elasticity which will facilitate its engagement with the set of attachment slats 14 of the support element.

The first attachment members are applied on a plateau 37, itself applied on the first side of the disc 32. This plateau will as if to say serve as a track for the slats when the connection foot will be engaged with the slats, which will facilitate the translatory movement which the support element will perform with respect to the connection foot. The first attachment members extend with respect to notches 39 provided in the plateau, which notches flow into an opening 38 of the first face. This facilitates the de-casting during the manufacture by casting of the connection foot.

For connecting the connection foot 30 to the pedestal 3, a second side 40 of the disc 32, opposed to the first side 33, is provided with a second attachment member 41 applied around the center of the disc, as illustrated in FIGS. 4 and 5. The second attachment member preferably comprises four first legs 42 applied among them so as to form a cercle. Each of the first legs being preferably provided with a first foot 43 applied at an end of the leg. Each first leg comprises a small wing 44 which extends substantially perpendicular on a back side of this first leg. The first legs are applied according to a cercle of which the center corresponds to the one of the discs 32. The first legs are applied in such a manner as to leave a space among them and thus form a central channel 46 which starts with a perforation 45 in the center of the disc. In such a manner a fixing screw can be, if necessary, engaged in this channel 46 for fixing the connection foot to the pedestal.

The connecting foot will be introduced in the head of the pedestal 3 by engaging the first legs in the central opening on the head of the pedestal. When the first legs will be engaged into the pedestal, their first foot 43 will grip under the head of the pedestal and retain the connection foot on the head of the pedestal. The engagement of the first legs in the opening on the head of the pedestal will not prevent the connection foot to rotate with respect to the head of the pedestal, because the first legs and their first feet retain the connection foot by friction and by the elasticity of the material of which they are manufactured. As the case may be a fixation screw can be engaged in the channel 46, This screw can grip into the small wings 44 applied on the first legs.

Figure 7:
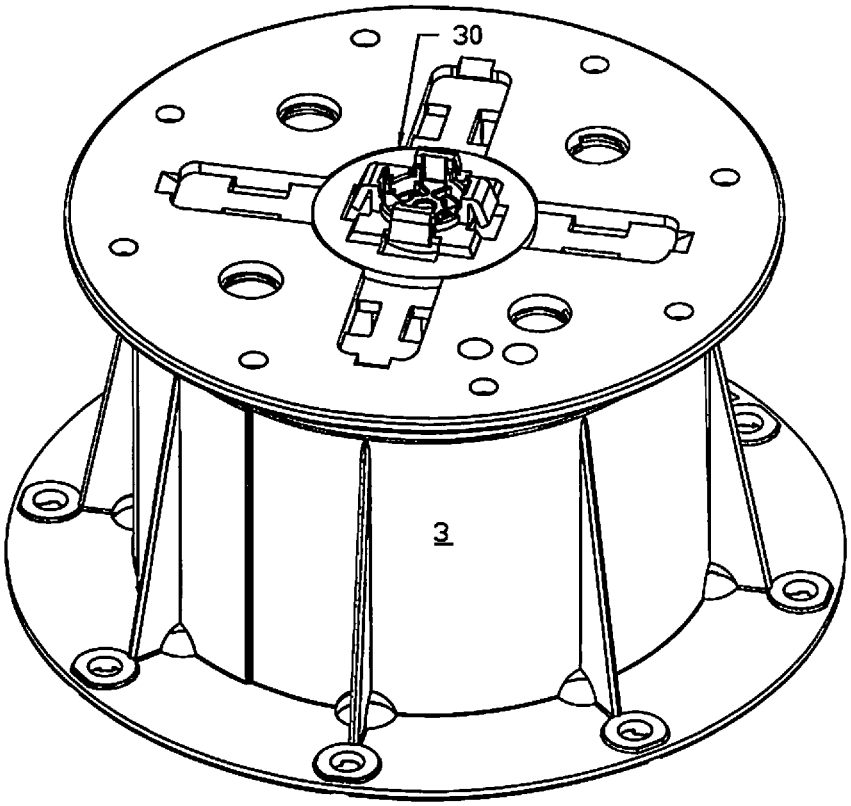
FIG. 7 shows the connection foot connected to the pedestal.

When the connection foot will be connected to the pedestal, the first attachment members 31 will extend as from the head of the pedestal, as illustrated in FIG. 7. It will than be possible to connect the support element by engaging the slats 14 with the first attachment members. Because two of the first attachment members will be housed between the two rows of slats, it will be possible to have the support element sliding along the first attachment members thereby imposing a translatory movement to the support element with respect to the head of the pedestal. If moreover the connection foot is not blocked by a screw on the head of the pedestal, it will also be able to rotate with respect to the pedestal head. It will thus be possible not only to impose a translatory movement to the support element, but also a rotational movement. The fact to be able to impose as well as a translatory as a rotation to the support element will enable a large possibility for positioning the support element with respect to a wall or a partition.

Figure 8:
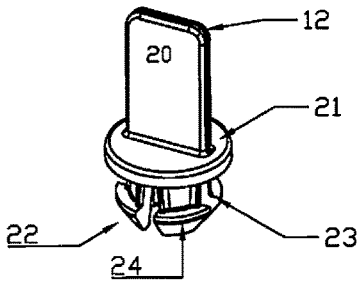
FIG. 8 shows an embodiment of an insert part to be used with the support element according to the invention.

As described here before the support element is provided with a set of insert parts 12, where each insert part provided for being applied in the first 10 or second 11 window as well as in the hole 13. FIG. 8 shows an embodiment of such an insert part 12. The latter comprises a wing 20 which extend in height as from a plinth 21. Under this plinth there is a third attachment member 22, provided for gripping on the support element.

The wing 20 extends for example over a height of 17 mm, in such a manner as to extend sufficiently in height, and thus maintain a distance between two adjacent soil covering elements, without however crossing the thickness of those covering elements. The wing preferably has a rectangular geometry with rounded upper corners. The plinth preferably has a circular shape in order to enable a rotation of the insert part when mounted in the window 10, 11 or in the hole 13. The third attachment member 22 is preferably formed by four second legs 23 applied among them such as to form a cercle. The four second legs are applied in an equidistant manner among them. Each of the second legs ends with a second foot 24 having a trapezoidal shape over its width and a conical shape over its height. The second foot forms a protrusion with respect to the second leg of which it is part.

The length of the second legs is shorter than the length of the skirt 19 for not disturbing the application of the support element on the head of the pedestal. The second legs being dimensioned in such a manner as to be housed under the border of the window or the hole which is located on the under side of the basis. Thus, when the insert part is housed in one of the windows or in the hole, the plinth 21 will be in the cut-out 16 and its under side will rest on the platform formed by the cut-out. The third attachment member will cross the window or hole and its second foot, by means of the protrusion it forms, will be housed under the lower border of the window or hole for thus retain the insert part in the window or hole. The fact that the second legs area at a distance from one another will enable to the latter to be flexible, thereby facilitating the introduction of these second legs in the window or hole. This introduction is also facilitated by the conical shape of the second foot.

The insert part is not retained in a rigid manner in the window, neither in the hole, in order to thus enable this insert part to slide and rotate in the window and rotate in the hole. This facility to have the insert part rotating and sliding in the support element will enable a large number of possibilities to apply the insert part which enable the use of the support element for a large number of soils covering elements having most diversified geometric shapes.

Figure 9:
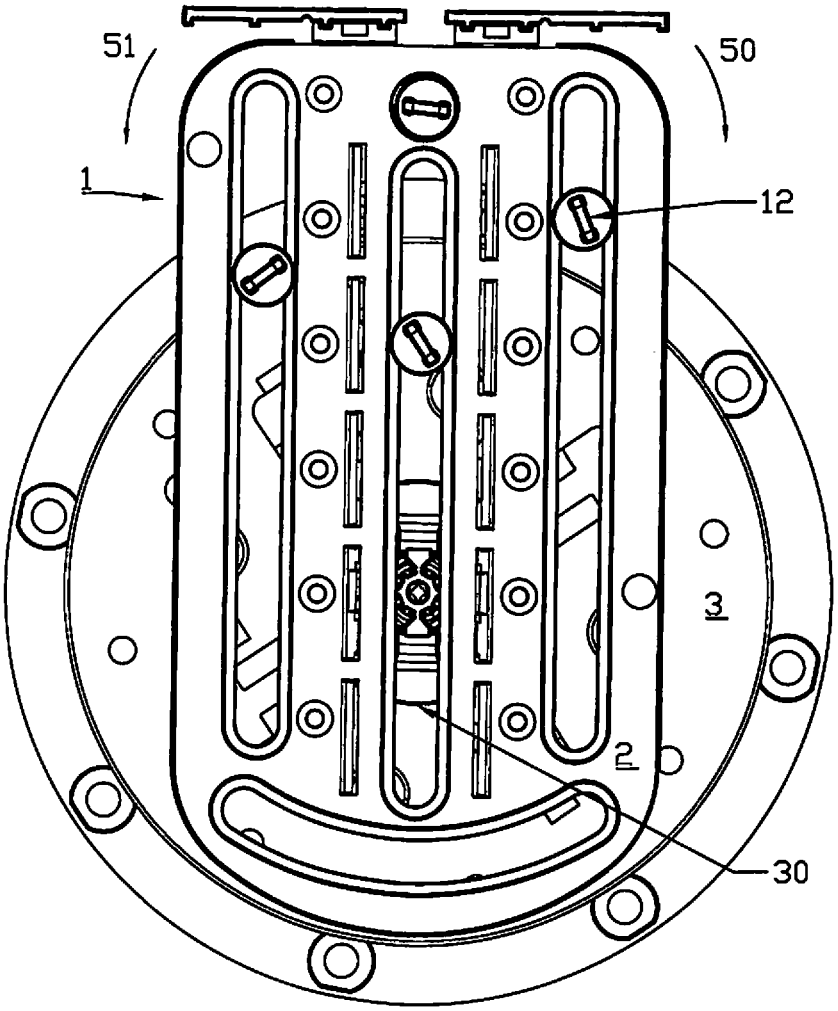
FIG. 9 shows the support element mounted on the connection foot.

FIG. 9 shows the support element mounted by means of the connection foot on the head of the pedestal. Because the connection foot can rotate on the head of the pedestal 3, the support element 1 fixed on this connection foot can be rotated over 360° as well clockwise as anti-clockwise, as indicated by the arrows 50 and 51. As moreover the support element can slide over the connection foot, this enables to combine the rotational movement with the translatory movement and thus to apply the flaps against the wall or partition. Finally, the fact that the insert parts can rotate and slide in the first and second windows as well as in the hole, enables a large adjustment range for correctly applying the inserts parts between the soil covering elements is possible and this for a large range of geometries of the soil covering elements.

FIG. 10*a* illustrates the use of the support element according to the invention when the wall or partition 25 is straight. The support element 1 is applied on the head of the pedestal 3. The flaps 6-1 and 6-2 are applied against the wall or partition 25. As the wall or partition is straight the flaps extend in a rectilinear manner. The soil covering 26 is applied in such a manner as to be carried by the support elements and the pedestal. The presence of the first windows 10 and the insert parts 12 housed in those first windows, enable by imposing a translatory and rotational movement on the insert parts to apply them in such a manner that they can extend between adjacent soil covering elements 26-1 and 26-2, even if the latter are not rectilinear.

Figure 10B:
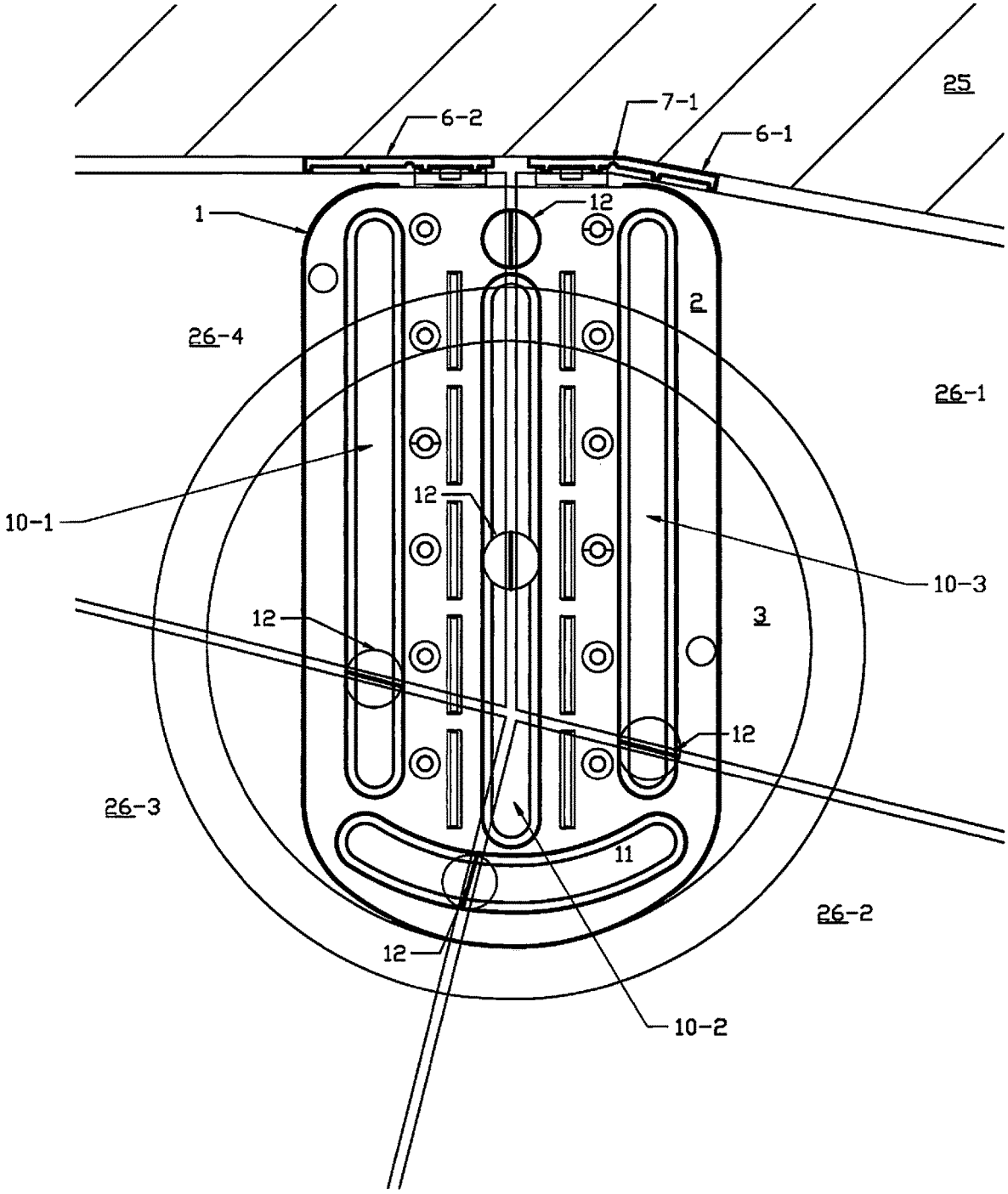

FIG. 10*b* illustrates the use of a support element according to the invention when the wall or partition 25 forms an angle. Due to the presence of the notch 7-1, it is possible to bend the first section of the flap 6-1 in order that it matches the angle of the wall or partition 25. In that FIG. 10*b* one also sees that the pedestal 3 is at a distance from the wall and that due to the fact that the support element can be moved on the head of the pedestal, it is possible to have it slide on the head of the pedestal until the flaps are in contact with the wall or partition. In an analogous manner as what has been described for FIG. 10*a*, the soil covering element will be supported by the support element and the pedestal. For adjusting the soil covering element 26-1 to the geometry of the wall or partition it will be enough to notch an angle of that soil covering element so that it can also match the geometry of the wall or partition. Due to the fact that the support element can be moved over the head of the pedestal and thus enter in contact with the wall or partition, the soil covering element will also be partly supported by the support element until against the wall or partition, thereby reducing the risk that they are cantilevered. The presence of these insert elements in the first and second windows will enable to apply the insert parts correctly between the adjacent soil covering elements.

Figure 10C:
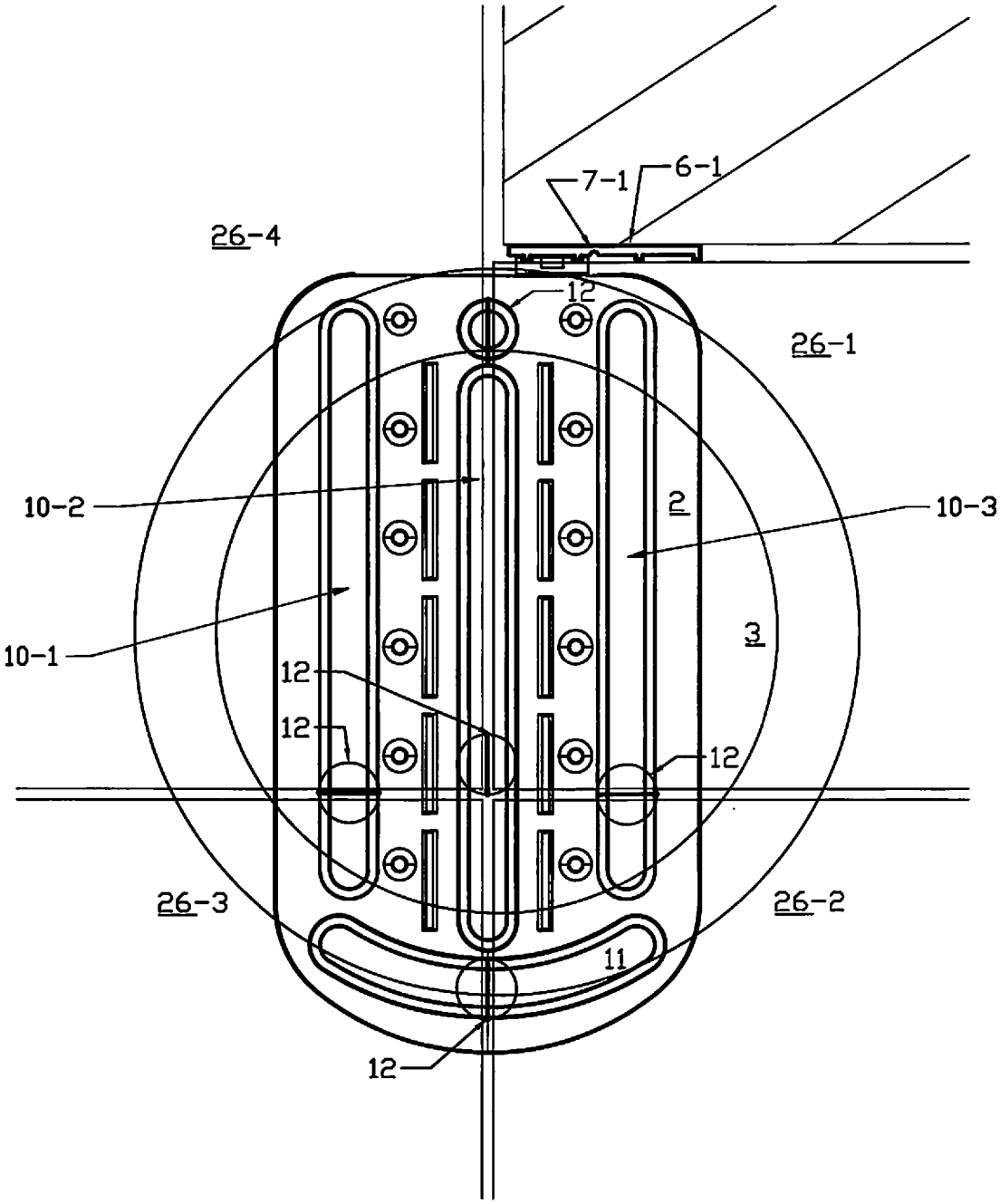

FIG. 10*c* shows the use of a support element according to the invention where the wall or partition 25 forms a 90° angle. One sees that the flap 6-1 has been removed in order to accommodate the support element to the geometry of the wall or partition. To this purpose it is enough to break or cut the flap 6-1 at the height of its foot 8-1. In case that it would be needed to still have a section of one of the flaps before reaching the angle of the wall or partition, it will be enough to remove only a section of the flap by using the notch 7 as a cutting line.

When the support element is correctly positioned with respect to the wall or partition it will be possible to fix it on the head of the pedestal by using screws which will be screwed in one or more of the perforations.

The invention claimed is:

1. A set comprising a connection foot and a soil covering element support element, which soil covering element support element comprises a basis provided for being applied on a surface raising pedestal, which basis comprises at a first longitudinal end a stop member which extends substantially perpendicular with respect to the basis, which connection foot is provided for connecting the soil covering element support element to the pedestal, characterized in that the basis of the soil covering element support element comprises a set of attachment slats which extend over at least 70% of the length of the basis, which connection foot comprises a set of first attachment members, the first attachment members being dimensioned and applied in such a manner as to be able to engage between the attachment slats of the set of attachment slats and enter into contact with them so as to enable a translatory movement between the soil covering element support element and the connection foot, which connection foot comprises a second set of attachment members provided for gripping with the pedestal and enabling a rotation of the connection foot with respect to the pedestal.

2. The set as claimed in claim 1, characterized in that the basis is provided with at least one first window which extends in a longitudinal way in the basis.

3. The set as claimed in claim 2, characterized in that the set of first attachment members comprises two pairs of first attachment members, the first attachment members being applied in such a manner that they each time form an angle of substantially 90° among them, one of the pairs being housed between the attachment slats and the other pair penetrates in the first window situated between the attachment slats of the first set when the connection foot is connected to the soil covering element support element.

4. The set as claimed in claim 2, characterized in that the basis also comprises a second window having a curved geometry, which second window extends at the height of a second longitudinal end of the basis, which second end is situated at an opposite side of the one of the first longitudinal end.

5. The set as claimed in claim 4, characterized in that the at least one first window and the second window is each applied in a hollowing out provided in the basis, respectively.

6. The set as claimed in claim 4, characterized in that it comprises a set of insert parts, each insert part being provided for being applied in each of the at least one first window and the second window, respectively, in such a manner as to be able to rotate within the window.

7. The set as claimed in claim 6, characterized in that each insert part is provided for being applied in each of the at least one first window and the second window, respectively, in such a manner that it can also perform a translatory movement within the window.

8. The set as claimed in claim 2, characterized in that the basis comprises a series of perforations crossing this basis.

9. The set as claimed in claim 8, characterized in that the perforations of the series of perforations extend along two rows and in that one of the at least one first window extends between the two rows of perforations.

10. The set as claimed in claim 1, characterized in that the attachment slats have an L shaped geometry which extend as from a lower face of the basis.

11. The set as claimed in claim 1, characterized in that the set of first attachment members is applied on a first side of a disc around a center of that disc.

12. The set as claimed in claim 11, characterized in that each first attachment member comprises a first segment which extends in a direction substantially perpendicular with respect to the first side of the disc and a second segment substantially perpendicular to the first segment and in a direction which extends so as to move away from the center of the disc, a third segment of the first attachment member being connected to the second segment and forms an angle situated between 15° and 35° with the first segment.

13. The set as claimed in claim 11, characterized in that the first attachment members are applied on a plateau, itself placed on the first face of the disc.

14. The set as claimed in claim 11, characterized in that the second attachment member is applied on a second side of the disc, opposed to the first, the second attachment member being applied around the center of the disc.

15. The set as claimed in claim 14, characterized in that the second attachment member comprises four legs applied among them such as to form a circle, each of the four legs being provided with a first foot.

16. The set as claimed in claim 15, characterized in that each first leg comprises a small wing extending substantially perpendicular on a back side of the first foot.

17. The set as claimed in claim 1, characterized in that the stop member is formed by at least one flap provided with a notch which extends over the height of the flap, the notch having a depth such as to enable a bending and/or a removal of a section of the flap situated between the notch and a distal end of the flap.

18. The set as claimed in claim 17, characterized in that the notch is situated in a part of the flap situated between ⅓ and ⅔, in particular between 4/9 and 5/9, of the length of the flap.

19. The set as claimed in claim 17, characterized in that the at least one flap is placed on a third foot and offset with respect to the basis.

20. The set as claimed in claim 1, characterized in that it comprises a hole situated at the height of the first longitudinal end, which hole is dimensioned for fixing therein an insert part.

21. The set as claimed in claim 1, characterized in that the basis is provided with drainage grooves.

* * * * *